United States Patent [19]

Christner et al.

[11] Patent Number: 4,960,428

[45] Date of Patent: Oct. 2, 1990

[54] METHOD FOR LIMING SKINS AND HIDES

[75] Inventors: Juergen Christner, Bickenbach; Ernst Pfleiderer, Darmstadt-Arheilgen; Tilman Taeger, Seeheim-Jugenheim, all of Fed. Rep. of Germany

[73] Assignee: Röhm GmbH, Darmstadt, Fed. Rep. of Germany

[21] Appl. No.: 303,270

[22] Filed: Jan. 26, 1989

[30] Foreign Application Priority Data

Jan. 29, 1988 [DE] Fed. Rep. of Germany ..... 3802640

[51] Int. Cl.[5] ..... C14C 1/04

[52] U.S. Cl. ..... 8/94.18; 8/94.1 R; 8/94.5; 8/94.17

[58] Field of Search ..... 8/94.1 R, 94.18, 94.17, 8/94.15

[56] References Cited

U.S. PATENT DOCUMENTS

| | | | |
|---|---|---|---|
| 3,986,926 | 10/1976 | Monsheimer et al. | 195/6 |
| 4,278,432 | 8/1981 | Monsheimer et al. | 8/94.18 |
| 4,294,087 | 10/1981 | Monsheimer et al. | 8/94.18 |
| 4,344,762 | 8/1982 | Monsheimer et al. | 8/94.18 |
| 4,877,853 | 10/1989 | Siol et al. | 526/329.7 |

OTHER PUBLICATIONS

Kirk–Othmer, Encyclopedia of Chemical Technology, vol. 8, The Interscience Encyclopedia, Inc., New York, pp. 294,295.

Kirk–Othmer, Encylopedia of Chemical Technology, vol. 14, John Wiley & Sons, New York, p. 209.

Mahler and Cordes, *Biological Chemistry,* Harper & Row, New York.

Gerbereichemie und Gerbereitechnologie, Stather, Akademie Verlag, Berlin, 1967.

Nomenclature of Organic Chemistry, Intl Union of Pure and Applied Chemistry, Butterworths, London, 1969, p. 229.

Organic Sulfur Compounds, Kharasch, vol. I, Pergmon Press, New York, 1961, p. 257.

*Primary Examiner*—Paul Lieberman

*Assistant Examiner*—John F. McNally

*Attorney, Agent, or Firm*—Curtis, Morris & Safford

[57] ABSTRACT

A process for liming skins and hides with preservation and separation of the hair, including the following successive steps:

(A) a soaking step in a aqueous liquor containing a surfactant;

(B) an incubation step in an aqueous liquor free of inorganic sulfur but containing hydrotropes and organic sulfur compounds as unhairing agents;

(C) an step for immunization of the hair at a pH between 10 and 14;

(D) a hair loosening step in which inorganic sulfide is added to the float;

(E) a separation step in which the hair is separated from the skins and hides; and (F) a liming step in which the pelts so obtained are limed in an aqueous alkaline liquor comprising liming aids.

21 Claims, No Drawings

METHOD FOR LIMING SKINS AND HIDES

The present invention relates to a process for the liming of animal hides and skins with preservation and recovery of the hair. More in particular, the process includes a soaking operation followed by a liming operation, with immunization of the hair by a controlled pretreatment with alkali.

THE PRIOR ART

In the manufacture of leather as practiced today, unhairing of the hides is carried out by the use of hydrated lime and inorganic sulifides. (See Kirk-Othmer, *Encyclopedia of Chemical Technology,* 3rd ed,. vol. 14, p. 209, John Wiley & Sons, 1981; Ullmanns *Enzyklopaedie der technischen Chemie,* 4th ed., vol. 16, p. 118, Verlag Chemie, 1978.) The hair-destoying unhairing methods using sulfides have a polluting effect on waste water and air and therefore have rightly been criticized. Enzymatic unhairing methods which use tryptic enzymes or fungal or bacterial proteases, occasionally also carbohydrolases, have been proposed from time to time. In practice, however, the use of enzymatic unhairing methods has largely been limited to the skins of small animals and even there has been minor.

As a rule, enzymatic unhairing does not yield hides or pelts that are completely free of short hair. On the other hand, it is occasionally observed that the grain is attacked to a greater or lesser extent by collagenolytically active enzymes, which are an ingredient of many commercial enzyme preparations.

Soaking processes using hydrotopes and optionally enzymes are known from German patent 29 44 461 or U.S. Pat. No. 4,344,762. An enzymatic process for hair recovery and simultaneous opening up of the skin structure by the use of substances cleaving disulfide bridges, for example mercaptans and thio fatty acids, has been described in German patent publication 29 17 376 or U.S. Pat. No. 4,294,087. German patent 29 29 844 or U.S. Pat No. 4,278,432 proposes an acid soaking process which also uses mercaptans and thio fatty acids or compounds with the structural element

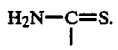

In the recent past, it has been sought to autmate the operating sequences in unhairing and also to develop an environmentally benign technology.

These efforts have given rise to the Darmstadt Continuous Process (see E. Heidemann in "Das Leder" 35, 143–150 [1984]), for example, and the so-called Csiro Lime Process, developed by Cranston, Davis and Scroggie in Australia (see R. W. Cranston et al., Leather 186, 229–231 [1984]).

THE OBJECT AND THE INVENTION

Thus there has been a need to provide a hair-preserving unhairing process in which the hair is largely preserved and separated, which entails minimal waste water pollution, and which yields high quality leathers.

It has now been found that the liming process of the invention meets these objectives to a high degree. It advantageously follows the known beamhouse operations. The inventive process is usually preceded by a dirt loosening soaking.

The process of the invention for the liming of hides and skins with preservation and recovery of the hair in a soaking operation followed by a liming operation with immunization of the hair by means of a controlled pretreatment with alkali comprises the following successive steps:

(A) A soaking step in which the hides and skins are treated for a period ranging from 4 to 48 hours with an aqueous liquor with a pH value between 7 and 10.5, and preferably between 8 and 10, and most preferably between 9 and 10, containing at least one surfactant.

(B) An incubation step in which the soaked hides and skins are treated with an aqueous liquor containing a depilatory which is substantially free of inorganic sulfide and comprises organic sulfur compounds having reducing action for from 30 to 180 minutes, and preferably from 45 to 90 minutes, at a pH value between 9 and 11, and preferably between 9.5 and 10.5.

(C) An immuization step in which the liquor, brought to a pH value between 10 and 14, and more particuylarly between 12 and 14, and preferably of 12.5±0.5, by the addition of bases is allowed to act on the hides and skins, which are kept in motion, for a period of from 1 to 12 hours, and preferably from 1 to 3 hours.

(D) A hair loosening step in which the liquor, to which inorganic sulfide has been added in an amount from 0.5 to 3 weight percent, based on the salted or fresh weight of the stock, is allowed to act on the hides and skins at a pH value between 10 and 14, and preferably between 12 and 14, for from 30 to 180 minutes.

(E) A separating step in which hair and hide or skin are separated from each other.

(F) A liming step in which the pelts so obtained are fully limed iwht the addition of water, alkali, and liming aids to the liquor, which must represent from 50 to 500 percent by weight of the hide or skin stock used.

A detailed description of how the process may be carried out follows:

(A) The soaking step

The pH value of the aqueous soak liquor is adjusted as usual with an alkali, preferably sodium-, less preferably potassium-, hydroxide, -carbonate or -bicarbonate, and optionally ammonium compounds such as ammonia, or a combination of alkalies.

Depending on the size of the vessels employed, the liquor usually represents from 50 to 500, and prefereably from 100 to 300, percent by weight of the salted hides or skins. When appropriate enzymes are used as soaking aids, the soaking operation will take longer. From a practical standpoint, soaking is best done overnight, preferably in the temperature range from 25° to 28° C. In a preferred embodiment, soaking is carried out in a liquor which contains enzymes suitable for the operation. These are preferably proteolytic enzymes (EC 3.4). Particularly preferred is the use of alkaline proteases with optimum activity in the approximate pH range from 7.5 to 13. (See Kirk-Othmer, 3rd ed., loc. cit., vol. 9; K. Aunstrup in B. Spencer, ed., Industrial Aspects of Biochemistry, vol. 30 [I], pp, 23–46, North Holland, 1974.)

Suitable are, in general:

Proteases of animal origin, such as pancreatic anzymes (pancreatin, EC 3.4.23);

proteases of microbial origin (see L. Kay in Process Biochemistry 1971, pp. 17–21, (a) from Bacillus species such as *B. subtilis, B. licheniformis, B. alkalophilus, B. cereus, B. natto, B. vulgatus, B. mycoides,*

(b) from Streptococcus species, (C) from Streptomyces species such as *Streptomyces fradiae, S. greseus, S. rectus,*

(d) from Aspergullus species such as *Aspergillus flavus-oryzae, A. niger, A, saitio, A. usamii,*

(e) from Mucor and Rhizopus species such as *Mucor pusillus, M. mietrei,*

(f) from Endothia species such as *Endothia parasitica,*

(g) from Trametes species such as Trametes sanguinea.

Advantageously a combination of enzymes is used, which preferably includes a bacterial protease. The latter, which may be derived from *Bacillus subtilis*, for example, advantageously accounts for 20 to 70 percent of the total enzymatic activity. Suitable further enzyme components are fungal proteases derived, for example, from *Aspergillus parasiticus*, which may account for 10 to 30 percent of the total activity, and/or pancreatic enzymes accounting for 10 to 20 percent of the total activity.

As a guide, the feed rate of the preteolytic enzymes should be such that the quantity present in the soak liquor corresponds to from 2,000 to 20,000 Löhlein-Volhard units per kilogram of salted or fresh weight of the hides and skins. The proteolytic activity of enzymes is costomarily determined by the Anson hemoglobin method (M. L. Anson, J. Gen. Physicol. 22, 79 [1939]) or by the Löhlein-Volhard method ("Die Löhlein-Volhardsche Methode zur Bestimmung der proteolytischem Aktivität", Gerbereichemisches Taschenbuch, Dresden-Leipzig, 1955) and expressed in LVU's (Löhlein-Volhard units). One LVU is the amount of enzyme which under the specified conditions of the method consumes 1.725 mg of casein. Moreover, in what follows, units which are derived from the Anson method are used for determination of the activity of enzymes active in the acid range. These are referred to as "proteinase units (hemoglobin)", $U_{Hb}$. One $U_{Hb}$ represents the amount of enzyme that will catalyze the liberation of fragments soluble in trichloroacetic acid from hemoglobin at a rate equivalent to 1 micromole of tyrosine per minute at 37° C. (measured at 280 nm). (1 $mU_{Hb}=10^{-3}\ U_{Hb}$.)

The soaking operation is carried out in the presence of at least one surfactant. The surfactants used are preferably anionic, and particularly neutral, surfactants as described in German patent 33 12 840 or Australian patent publication 558,447, for example, or mixtures of the two. (See F. Stather, Gerbereichemie and Gerebereitechnologie, Akademie-Verlag, Berlin, 1967.) As a rule, from 0.1 to 1, and preferably from 0.1 to 0.3, weight percent of the surfactants, based on the salted weight of the hides and skins, are used. Particularly preferred is the concurret use of neutral and anionic surfactants, for which a ratio of from 3:1 to 10:1 parts by weight will serve as a guide.

Illustrative of the surfactants are the following types. (The products in parentheses are commercial products given by way of example).

(A) Polyethylene glycol derivatives (a) Fatty acid polyethylene glycols (Emulphor ®)

(b) Fatty alcohol polyethylene glycol ethers (Foryl D ®)

(c) Alkylphenol polyethylene glycol ethers (Eumulgin ® 286, Fluidol W100 ®, Igepal C ®)

(d) Fatty acid ethanolamide polyethylene glycol ethers (C ®, Foryl KW ®, Eumulgin ®)

(B) Glycerol derivatives (a) Fatty acid monoglycerides (Tegomol S ®)

(b) Fatty acid polyglycerol esters

Moreover, anionic emulsifiers of the following types, for example:

(C) Sulfates: $R'OSO_3Na$ (a) Fatty alcohol sulfates, premary (Eppol DL conc. ®, Peramit ML ®) secondary (Teepol ®)

(b) Ethoxylated fatty alcohol sulfates (Texapon Q ®)

(c) Monoglyceride sulfates (Vel ®)

(d) Sulfation products of unsaturated oils and fatty acids (Lederolinor DKMS ®)

(D) Sulfonates: $R\ SO_3Na$ (a) Alkylbenzene sulfonates (ABS, TPS) (Marlopon ®, Marlon ®)

(b) Alkyl sulfonate (Mersolate ®)

(c) Fatty acid condensation products (Igepon A ®, Igepon 1 ®)

(d) Petroleum sulfonates (contained in Grassan B ®)

(e) Sulfitation products of unsaturated fatty oils and fatty acids (Cutisan BS ®)

(f) short-chain alkylbenzene sulfonates of cumene, toluene or xylenol, for example, wherein the group R' represents, unless otherwise indicated, a long-chain alkyl group, preferably having from 8 to 28 carbon atoms.

The soaking operation may be carried out within the process of the invention by placing the salted hide stock into soak water to which one or more surfactants have been added or will be added in the course of the operation, preferably in the concentrations indicated. The soaking operation may be carried out in the equipment usually employed for the purpose, for example, a mixing tan, drum, tanning machine, or paddle wheel.

(B) The incubation step

This step is preferably carried out with fresh aqueous liquor to assure, for ne thing, the constancy of the reaction conditions. The liquor in which the soaked hides or skins are incubated is substantially free of inorganic sulfide. The liquor preferably represents from 50 80 percent by weight of the salted or fresh hides or skins. It contains a depilatory composed of (1) at least one organic sulfur compound which here exerts a reducing action, in amounts of from 0.05 to 5 weight percent based on the salted or fresh weight of the hides or skins;

(2) at least one hydrotrope in amounts of from 0.05 to 2 weight percent based on the salted or fresh weight of the hides or skins; and (3) one or more amines in amounts of from 0 to 2, and preferably from 0.05 to 2, weight percent based on the salted or fresh weight of the hides or skins, which act synergistically in the sense of the objective to be accomplished.

The pH value of the liquor in the incubation step is between 9 and 11, the preferably between 9.5 and 10.5. This pH value is obtained partly through the amine and partly by adding alkali in the form of alkaline mercaptides.

Organic sulfur compounds having reducing action are effective according to the present invention if, at pH 10 to 12.5, they are capable of cleaving the disulfide bridges of the prekeratin while leaving those of the outer hair keratin largely intact. In other words, the redox potential of the organic sulfur compound, which is pH-dependent, may be higher in the depilatory system than that of the keratin. ($E_0 = -420$ mV.) Even if this conceptual model is not fully adopted, it does permit the selection of suitable organic sulfur compounds.

Suitable organic sulfur compounds having reducing action are premarily those of the formula $$R_1—SH \quad (I)$$

wherein $R_1$ is an optionally branched, optionally cyclic alkyl group having from 2 to 24, and more particularly from 2 to 18, and preferably from 2 to 12, carbon atoms, the alkyl group being optionally hydroxy- or thiol-substituted; or a $—(CH_2)p—NR_2R_3$ group wherein $R_2$ and $R_3$ are, independently of each other, hydrogen or an alkyl group having from 1 to 6 carbon atoms, or, with inclusion of a further nitrogen, oxygen, or sulfur atom, form a preferably saturated hetercycle, and p is an integer from 2 to 6; or a $—R_4—COOR_5$ group where $R_4$ is an alkyl group having from 2 to 6 carbon atoms which is optionally branched and optionally substituted stituted with a further $COOR_5$ group, —SH being optionally bound to a primary, secondary or tertiary carbon atom, and wherein $R_5$ is hydrogen or an alkyl group having from 1 to 6 carbon atom; or formamidinosulfinic acid, $H_2N—C(=NH)SO_2H$.

Examples of compounds of formula (I) are mercaptans, and especially n-alkyl mercaptans such as n-butyl mercaptan, n-amyl mercaptan, n-dodecyl mercaptan, mercaptans from Lorol® types, n-tetradecyl mercaptan as well as hydroxy-substituted alkyl mercaptans such as 2-mercaptoethanol or 3-mercapto-1,2-propanediol, and amine-substituted alkyl mercaptains such as beta-(di-n-amylamino)ethyl mercaptan, these compounds being present predominantly in the form of their salts according to the pH value.

Further examples are the mercapto mono- and dicarboxylic acids or their salts, such as mercaptoacetic acid, 2-mercaptopropionic acid, 3-mercaptopropionic acid, and mercaptosuccinic acid. Another example is formamidicnosulfinic acid (thiourea dioxide).

Suitable hydrotropes have been listed by H. Rath et al. in Melliands Texilbericht 43(7), 718 (1962), for example.

The hydrotropes used are preferably of the formula $$H_2N—\underset{\underset{R}{|}}{C}=X, \quad (II)$$

wherein R is hydrogen, $—NH_2$, $—CH_3$, or —NH—CN, and X is oxygen, sulfur, or =NH, or wherein R and X taken together form a 5— or 6— membered heterocyclic ring comprising one, two, or three nitrogen atoms as the sole hetero atoms; and/or acid addition salts such as hydrchlorides, sulfates, phosphates, as well as thiocyanates, formed from such compounds. Examples are, in particular, urea, thiourea, acetamide, formamide, guanidine, melamine, and dicyandiamide.

The same equipment may be employed as in the soaking operation. Here, too, the operating temperature preferably ranges from 25° C. to 28° C.

The unhairing agent may contain a suitable amine as an optional further component. This should be a toxicologically and ecologically innocuous amine, for example an amine of low volatility.

The amine is preferably one of the formula $$R_6NR_7R_8 \quad (III)$$

wherein $R_6$ is alkyl having from 1 to 8 carbon atoms or such alkyl substituted with a hydroxy group, and may be cyclic, and $R_7$ and $R_8$, taken alone, are hydrogen or have the same meanings as $R_1$, or wherein $R_7$ and $R_8$ taken together with the nitrogen atom form a 5— or 6— membered hetercylce. If such a hetercylce is present, then $R_6$ may also be hydrogen.

By definition, the amine component may be a primary, secondary, or tertiary amine, or a mixture of several amines. A good choice would be a hydroxy substituted alkylamine such as ethanolamine, diethanolamine, or triethanolamine, for example. Other examples are dimethylamine, diethylamine, cyclohexylamine, and piperidine.

(C) The immuization step

This step is tantamount to alkali activation of the depilatory system (while from the technical standpoint the incubation step amounts to pretreatment with the reducing agent at a low pH). The immunization step is characterized by the addition of bases to or the presence of bases in the liquor whereby a pH value between 10 and 14, and preferably between 12 and 14, is obtained. As a rule, the pH value in the immunization step thus is somewhat higher, for example by at least 0.5 to 1 pH unit, than the pH in the incubation step. A reasonable mechanistic interpretation might be that during the immunization step the cysteine in the keratin undergoes a conversion to lanthionine.

The increase in the redox potential of the depilatory system with the organic sulfur compound having reducing action, brought about by the increase in pH, must be viewed in this context.

The duration of the immunization step usually ranges from 1 to 5 hours, and more particularly from 1 to 3 hours, and preferably is closer to 1 hour. It has proved practical to carry out this step in a tanning drum or paddle vat. Agitation of the stock, preferably intermittent, will be advantageous. As a rule of thumb, the stock should be kept in motion half the time, at about 10-minute intervals. The operating temperature preferably ranges from 25° to 28° C.

In principle, inorganic bases, for example, alkalis, may be used predominantly, as in liming. However, the use of calcium oxide in the hydrate form commonly used in liming (hydrated lime; see F. Stather, Gerbereichemie and Gerbereitechnolgie, p. 169, Akademie-Verlag, Berlin, 1967) has proved practical. The hydrated lime is generally added to the liquor in an amount from 0.5 to 5 weight percent, based on the weight of the hides or skins.

However, the incubation and immunization steps may also be merged, the components of the depilatory being used simultaneously with the base, specifically hydrated lime.

(D) The hair loosening step

The active agent in this step is inorganic sulfide, that is, sulfide or hydrogen sulfide anoins. These are appropriately added in the form of NaHS or $Na_2S$. In the former case, about 0.7 to 1.2 weight percent of sodium hydrosulfide (usually 72%), and in the latter case, from 1 to 2 weight percent, based on the weight of the hides or skins, is used. The pH value should be between 10 and 14 and preferably is between 12 and 14. The exposure time should not be less than 20 to 30 minutes and may be as long as from 1 to 3 hours. Here, too, the temperature advantageously ranges from 25° to 28° C. It may be hypothesized that the loosening of the hair is due to the redox potential of the sulfide containing solution, which under the conditions employed is very high ($E_0 = -500$ to $-550$ mV), and which is sufficient for the more or less complete reduction of the prekeratin without destroying the immunized outer hair keratin.

(E) The hair separating step

The treatment results in the separation of hair and skin. By pumping the unhairing liquor through an exteral screen, the hair can be completely removed and then washed and dewatered. However, the hair may also be left in the liquor, with liming or the opening of the skin structure then following. In that case, the hair is separated later by way of a mechanical preclarification.

(F) The liming step

The liming step serves to remove the short hair and to complete the opening of the skin structure. The pelts are not fully limed after the preceding operations; roundly from one-third to one-half of the thickness of the pelts is usually thoroughly limed. The complete liming of the hides is generally done with freshening of water, alkali and liming aids. There are various ways of carrying out liming. For example, liming aids and lime can again be added to the liquor, preferably in amounts of from 1 to 4 weight percent, and inorganic sulfides in amounts of from 0.3 to 0.6 weight percent, based on the hides.

The duration of the liming step usually ranges from 20 to 24 hours.

Pelts having desirable smoothness and freedom from scud are obtained. Little stretch is observed. Overall a dimensional gain may be obtained.

Starting out with a hide which on the average is one-third limed, the procedure in another process variation is as follows: First the liquor is drained and the hides are taken out of the vessle and washed, preferably by the use of acids which are acceptable from the tanner's point of view, for example organic acids such as acetic acid or phosphonic acids (see German patent 35 33 203) or acidic polyphosphates, to reduce the slipperiness of the the hides and to facilitate their handling. Then the hides are conventionally fleshed and split. (See F. Stather, Gerbereichemie and Gerbereitechnologie, Akademie-Verlag, Berlin, 1967.)

The split leathers are treated further, usually for from 6 to 36 hours, in a split-leather liming operation, preferably in the drum, advantageously with the immunization liquor which has been saved from the immunization step (C), and to which lime and sulfide, or possible further liming auxiliaries, are added.

The liquor from the split-leather liming operation is advantageously stored in a tank for further use or recycling.

The flesh splits are advantageously limed in the liquor from the split-leather liming operation, with freshening of the lime and water; in other words, "open" recycling is practised. Here, too, it is advisable that the liming treatment, preferably carried out at from 25° to 28° C., last from 6 to 36 hours.

Advantageously there is added to the flesh-split lime liqour an oxidizing agent suitable for the oxidation of sulfur in the sulfide stage, preferably from the group consisting of peroxy compounds such as peroxides or ferric salts, manganous salts, permanganates or quinones, usually in amounts of from 0.001 to 1 weight percent, based on the weight of the flesh split.

Flesh-split liming with sulfide oxidation is carried out in a mixing vessel with recirualtion of the liquor. As a guide, about 50 to 150 ppm of a manganous salt, for example, manganous sulfate, is admixed with it. Under the action of the oxidizing agent, elemental sulfur separates out, usually in colloidal form. In this way, the sulfide content of the liquors can be reduced by 70 to 95 percent.

ADVANTAGES

The process of the invention with the contemplated sequence of technolgical steps yields a number of unexpected advantages, including reduced pollution. Among these advantages are:

Reduction of the pollutant load in the lime liquor by about 30 to 50 percent with respect to chemical oxygen demand, by 40 to 60 percent with respect to sulfide, by 30 to 40 percent with respect to nitrogen, and by 60 to 70 percent with respect to solids.

Substantial preservation of the hair structure, hence improved ease of dehydration.

The ability to split the hide in its native state since after removal of the hair only from 20 to 25 percent of the hide is fully limed. Splitting the hide in this condition yields very smooth leathers.

A high degree of operational reliability since the risk of hair-root immunization in protracted hydrated-lime treatment is eliminated.

The examples which follow will serve to illustrate the invention. The chemical oxygen demand (COD) is determined on the basis of Ullmanns Enzyklopädie der technischen Chemie, 4th ed., vol. 6, p. 376 (1981).

EXAMPLES

Unless otherwise indicated, the percentages given are weight percent based on the weight of the hides and skins used.

EXAMPLE 1

Hair preserving process for the liming of cattlehides in the tanning drum for the manufacture of shoe upper leathers. Process without intermediate splitting of the hides.

Starting material

German cattlehides (25 to 29 kg) which have undergone dirt-loosening soaking. The percentages are based on the salted weight or on the green weight.

Main soak 150 percent water, 28° C.

0.25 percent proteolytic enzyme based on bacterial proteases, activity 4500 LVU/g 0.2 percent caustic soda, 50%

0.3 percent of a nonionic surfactant (nonylphenol with 8 to 9 moles of ethylene oxide)

Allow to run for 270 minutes. Specific gravity 3° Bé, pH 9 to 9.5. Drain the liquor.

Incubation step 50 percent water, 27° C.

1.2 percent of a liming aid composed of 10 wt. % triethanolamine, 20 wt. % thioglycerol, 14 wt. % guanidine hydrochloride, 66 wt. % water Agitate for 30 minutes, allow to stand for 30 minutes; pH 10 to 10.8.

Immunization step

+1 percent hydrated lime. Agitate for 60 minutes.

Hair loosening step

+0.7 percent sodium hydrosulfide (72%)

Hair starts to loosen after 20 minutes. The hair is continuously separated by means of an external screen. After some 90 to 120 minutes, the hides are free of hair. The liquor is also largely free of hair.

Main liming

+100 percent water, 26° C.
0.3 percent sodium hydrosulfide
2.5 percent hydrated lime
Agitate for 15 minutes.
0.2 percent caustic soda, 50%
Agitate for 1 minute every hour for 14 hours. Drain liquor.

Waster water values of residual lime liquor

Sulfide content: 1,150 milligrams/liter
COD: 20,300 mg $O_2$/l.

Comparative values

Conventional hair destroying liming: liming with the same amount of available sulfide and the same liming duration (without after-liming):
Sulfide content: 1,260 mg/l
COD*: 31,700 mg $O_0$/l
(*) Any necessary afterliming (150% water, 3.5% hydrated lime; 8 hours) will increase the COD value by approximately 16,000 to 18,000 mg $O_2$/l.

Washing

Washing is done twice, each time for 15 minutes with 200 percent water and
0.1 percent 1,1-hydroxyethanediphosphonic acid, 60%

EXAMPLE 2

Hair preserving process for the liming of cattlehides in the tanning drum for the manufacture of shoe upper leathers. Process with intermediate splitting of the hides.

Intermediate splitting means, that the hides after dehairing are washed and are fleshed and eventually split in a non-swollen, partly limed state. The split leather then are thoroughly limed using the dehairing liquor which has been fortified on addition of the washing liquor mentioned above with lime and alcali sulfide. The flesh splits are limed in the liquor obtained from the split leather liming with addition of hydrated lime. During the liming of the flesh splits also oxidation of residual sulfide is effected by adding manganous sulfate with vigorous agitation (for introducing oxygen).

Starting material

Salted or fresh German cattlehides (25 to 29 kg) which have undergone dirt-loosening soaking. The percentages are based on the salted weight or on the fresh weight.

The process operations from main soaking to the hair loosening step are identical with those of Example 1.

On completion of hair separation, the liquor is discharged to and stored in a tank A. Afterwards the hides are washed.

Washing 200 percent water
0.1 percent hydroxyethanediphosphonic acid, 60%

Agitate for 20 minutes. Discharge the liquor to a tank B and store it therein for further use.

The hides are taken out of the drum, fleshed, and split to give a split leather from 2.5 to 3.5 mm thick. The split leather and flesh split so obtained are partly limed and are separately processed further as described in the following:

Liming of split leather (The percentages given are based on the weight of the leather split.)
110 percent of the wash liquor from tank B
+ the entire unhairing liquor from tank A
+3 percent hydrated lime
0.3 percent sodium hydrosulfide, 72%
Agitate for 5 minutes.
+0.2 percent caustic soda, 50%.
Agitate for 1 minute every hour for 20 hours. Discharge liquor to a tank C and store it therein.

Waste water values of lime liquor

Sulfide content: 1,010 mg/l
COD*: 21,350 mg $O_2$/l.
(*) In the process variation with intermediate splitting of the hides, afterliming for about 8 hours is not necessary.

Washing of leather split

Washing is done twice, each time for 15 minutes with 200 percent water and
0.1 percent 1,1-hydroxyethanediphosphonic acid, 60%

Liming of flesh split (The percentages given are based on the weight of the flesh split.) Liming of flesh split is carried out in the liquors obtained from liming split leather after adding lime and manganous sulfate. Moreover vigorous agitiation is effected in a mixing vessel such as a tanning drum, paddle wheel or mixer in order to provide for oxidation of the sulfide present.

Place flesh split in a mixing vessel provided with means for recirculation of the liquor. Add liquor from tank C
+3 percent hydrated lime
+0.2 percent caustic soda
+100 ppm manganous sulfate (add diluted with water in the ratio of 1:20) (Proportion of manganous sulfate is based on liquor ratio. Agitate for 14 hours.

Waste water values

Sulfide content: 75 mg/l
COD: 17,450 mg $0_2$/l

These values should be compared with those of a conventional hair-destroying process. (See Example 1.)

Washing of flesh split

Washing to be done twice, each time for 15 minutes with 200 percent water and
0.1 percent 1,1-hydroxyethanediphosphonic acid, 60%

EXAMPLE 3

Hair preserving process for the liming of salted calfskins in the paddle wheel.

Starting material

Salted calfskins (20 to 24 kg) which have undergone dirt-loosening soaking. The percentages are based on the salted weight.

Main soak 240 percent water, 22° C.
0.2 percent of a nonionic surfactant (nonylphenol with 8 to 9 moles of ethylene oxide)
0.1 percent of a preserving agent (chloracetamide)
Keep in motion for 15 minutes, allow to stand for 120 minutes. Total soaking time: 20 to 22 hours. Drain liquor.

Enzyme soak 240 percent water
0.2 percent of a proteolytic enzyme based on a bacterial protease from Bacillus subtilis, activity 3,200 LVU/g
0.8 percent soda
Keep in motion for 3 hours; pH 9.3 to 9.7. Drain liquor.

Incubation step 240 percent water
1.4 percent of a mixture composed of 10 wt. % triethanolamine, 20 wt. % thioglycerol, 14 wt. % guanidine hydrochloride, 66 wt. % water
Keep in motion for 30 minutes, allow to stand for 30 minutes.

Immunization step

+2 percent hydrated lime
Keep in motion for 30 minutes, allow to stand for 30 minutes, keep in motion for 30 minutes.

Hair loosening step

+0.8 percent sodium hydrosulfide, 72%
Keep in motion for 10 minutes.
+0.8 percent sodium hydrosulfide, 72%
Keep in motion for 90 minutes until the skins are free of hair. Separate the hair by recycling.

Liming

+2 percent hydrated lime
Keep in motion for 30 minutes.
+0.6 percent sodium sulfide, 60%
Keep in motion for 30 minutes. Then keep in motion for 15 minutes and allow to stand for 120 minutes for from 16 to 20 hours: pH 12.2 to 12.6. Drain liquor.

Washing

Wash twice, each time for 15 minutes with
250 percent water and
0.1 percent 1,1-hydroxyethanediphosphonic acid, 60%

EXAMPLE 4

Hair-preserving process for the liming of dried goatskins.

Starting material

Dried goatskins. The percentages are based on the dry weight.

Soak 800 percent water, 28° C.
1.3 percent of a proteolytic enzyme based on bacterial proteases, activity 4,500 LVU/kg
1 percent of a nonionic surfactant (nonylphenol with 8 to 9 moles of ethylene oxide)
0.2 percent of a preserving agent based on chloracetamide
4.5 percent soda
Keep in motion for 10 minutes. Then keep in motion for 2 mintues and allow to stand for 30 minutes for from 22 to 24 hours; pH 9.3 to 9.8. Drain liquor, tumble dry for 30 minutes.

Incubation and immunization step 250 percent water, 28° C.
5 percent of a liming aid composed of 10 wt. % triethanolamine, 20 wt. % thioglycerol, 14 wt. % guanidine hydrochloride, 66 wt. % water
3.5 percent hydrated lime
Keep in motion for 6 minutes.

Hair loosening step

+50 percent water, 28° C.
5 percent sodium hydrosulfide, 72%
3.5 percent 33% soda solution; add diluted 1:5
Keep in motion from 90 to 120 minutes until the skins are free of hair. Separate the hair by recycling.

Liming

+100 percent water, 28° C.
4 percent hydrated lime
0.7 percent sodium hydrosulfide, 72%
Keep in motion for 60 minutes. Then keep in motion for 5 minutes and allow to stand for 60 minutes for from 18 to 22 hours: pH 12.3 to 12.6. Drain liquor.

Washing

Wash twice, each time for 15 minutes with
400 percent water, 26° C., and
0.1 percent 1,1-hydroxyethanediphosphonic acid, 60%

EXAMPLE 5

Example 5 is carried out as described in Example 1 except that the following composition is applied in the incubation step. (1.8% by weight of the brine weight.)
15 percent diethanol amine
10 percent thioglycolic acid
17 percent urea
water added to 100 percent. The sulfide content and the COD value of the liming liquor are almost identical with those obtained in example 1.

EXAMPLE 6

Example 6 is carried out as described in Example 1 except that the following composition is used as a liming adjuvant (1.5 percent) in the incubation step
22 percent of a 5.5 percent aqueous solution of the sodium salt of mercaptoethanol
5 percent dimethylamine
10 percent ammonium cumeric sulfonate
water added to 100 percent.

EXAMPLE 7

Example 7 is carried out as described in Example 1 except that the following composition is used as a liming adjuvant (1.0 percent by weight of the brine weight) in the incubation step:
25 percent urea
75 percent thiourea-S,S-dioxide.
The compositions used in Examples 5 to 7 are also employed successfully in the process according to Example 2.

EXAMPLE 8

Example 8 is carried out as described in Example 1 except that the following mixture of nonionic surfactants is employed (0.25 percent based on the brine weight) for soaking 40 percent $C_{11}$–$C_{15}$ oxoalcohol with 6 moles of ethylene oxide 20 percent $C_{11}$–$C_{15}$ oxoalcohol with 9 moles of ethylene oxide 20 percent $C_{11}$–$C_{15}$ oxoalcohol with moles of ethylene oxide.

EXAMPLE 9

The procedure is carried out as in Example 1 except that 0.2 percent (based on the brine weight) of the following mixture was used for soaking:

20 percent sodium dodecyl phenylsulfonate 40 percent sodium salt of $C_9$–$C_{18}$ fatty alcohol ether sulfate; water added to 100 percent.

EXAMPLE 10

The procedure of Example 1 is used except that for soaking 0.2 percent of an enzymatic composition based on bacterial, fungal and pancreatic proteases is employed:

2500 LVE/g protease from a strain of *Bacillus licheniformis*

1000 LVE/g fungal protease from *Aspergillus parasiticus*

1000 LVE/g pancreas protease.

What is claimed is:

1. A process for liming salted or fresh skins and hides with preservation and separation of removed hair, which method comprises the following successive steps:

(A) soaking said skins and hides for 4 to 48 hours at a pH between 7 and 10.5 in an aqueous liquor containing at least one surfactant;

(B) incubating said soaked skins and hides for 30 to 180 minutes at a pH between 9 and 11 in an aqueous liquor substantially free of inorganic sulfide which provides sulfide or hydrogen sulfide ions and containing an unhairing agent comprising a hydrotrope and an organic sulfur compound having reducing action;

(C) immunizing hair by bringing the pH of the liquor of (B) to between 10 and 14 by the addition thereto of a base and agitating the skins and hides in the resultant liquor for 1 to 12 hours;

(D) loosening hair by adding inorganic sulfide providing sulfide or hydrogen sulfide ions to the liqour of (C) in an amount from 0.5 to 3 percent by weight of the salted or fresh skins and hides and contacting said skins and hides therewith at a pH of 10 to 14 for 30 to 180 minutes;

(E) separating the skins and hides from the loosened hair; and (F) fully liming the unhaired skins and hides in from 50 to 500 percent, by weight of the salted or fresh skins and hides, of aqueous liqour comprising inorganic sulfide which provides sulfide or hydrogen sulfide ions, alkali, and liming auxiliaries.

2. A process as in claim 1 wherein the surfactant in (A) is at least one member selected from the group consisting of nonionic and anionic surfactants.

3. A process as in claim 1 wherein the surfactant in (A) is present in an amount from 0.1 to 1.0 percent by weight of the salted or fresh skins and hides.

4. A process as in claim 1 wherein the soak liquor in (A) comprises at least one proteolytic enzyme in an amount which is from 2000 to 20,000 Lölein-Vollhard units per kilogram of salted or fresh weight of the skins and hides.

5. A process as in claim 4 wherein said proteolytic enzyme is a mixture of bacterial protease, fungal protease, and pancreatic protease in which said bacterial protease provides from 20 to 70 percent of the total enzyme activity.

6. A process as in claim 1 wherein the organic sulfur compound of (B) having reducing action is a member of the group consisting of (1) formamidinosulfinic acid and (2) compounds of the formula $R_1SH$, wherein $R_1$ is alkyl having from 2 to 24 carbon atoms or is cycloalkyl, or is such alkyl or cycloalkyl substituted by hydroxyl or thiol; or $R_1$ is $—(CH_2)_pNR_2R_3$, wherein p is an integer from 2 to 6 and $R_2$ and $R_3$, taken alone, are independently hydrogen or alkyl having 1 to 6 carbon atoms, or $R_2$ and $R_3$, taken together with the nitrogen atom and a further nitrogen, oxygen, or sulfur atom, form a heterocycle; or $R_1$ is $—R_4—COOR_5$, wherein $R_4$ is alkyl having from 2 to 6 carbon atoms or such alkyl substituted by a $—COOR_5$ group, and $R_5$ is hydrogen or alkyl having from 1 to 6 carbons atoms.

7. A process as in claim 1 wherein the hydrotrope of (B) is at least one member of the group consisting of (1) compounds of the formula $$H_2N—\underset{\underset{R}{|}}{C}=X,$$

wherein R, taken alone, is hydrogen, $—NH_2$, $—CH_3$, or NH—CN; X, taken alone, is oxygen, sulfur, or =NH; or wherein R and X, taken together with the nitrogen atom forms a heterocycle containing one, two, or three nitrogen atoms as the sole hetero atoms therein; and (2) acid addition salts of such compounds.

8. A process as in claim 1 wherein the unhairing agent of (B) comprises an amine of the formula $$R_6NR_7R_8,$$

wherein $R_6$ is alkyl having from 1 to 8 carbons atoms or is cycloalkyl or is such alkyl or cycloalkyl substituted by hydroxy, $R_7$ and $R_8$, taken alone, are hydrogen or have the same definition as $R_6$; or $R_7$ and $R_8$, taken together with the nitrogen atom, form a 5- or 6-membered heterocycle, in which case $R_6$ may also be hydrogen.

9. A process as in claim 1 wherein fresh aqueous liqour is used in (B).

10. A process as in claim 1 wherein the base in (C) is hydrated lime.

11. A process as in claim 1 wherein the liming of (F) is carried out over 12 to 36 hours.

12. A process as in claim 1 wherein, after completion of unhairing and separation of hair from the skins and hides (E), the liquor is separated and used further for liming.

13. A process as in claim 12 wherein the unhaired skins and hides, separated from the liquor, are fleshed and split and then are fully limed.

14. A process as in claim 12 wherein the unhaired skins and hides, separated from the liquor, are washed for 10 to 30 minutes with fresh water comprising an agent for neutralizing alkali.

15. A process as in claim 14 wherein the washed unhaired skins and hides are fleshed and split and then are fully limed.

16. A process as in claim 14 wherein the wash water is separated and used, in combination with the liquor separated in (E) and with addition of inorganic sulfide, alkali, and liming auxiliaries, for further liming according to (F).

17. A process as in claim 16 wherein unwashed or washed partially limed split leather is fully limed for 6 to 36 hours.

18. A process as in claim 17 wherein the liquor from split leather liming is reused for the further liming of split leather according to (F) after addition thereto of alkali.

19. A process as in claim 17 wherein said further liming of split leather is carried out in the presence of an oxidizing agent.

20. A process as in claim 18 wherein said further liming of split leather is carried out in the presence of from 0.001 to 1 percent by weight of the flesh splits of an oxidizing agent selected from the group consisting of peroxy compounds, ferric salts, manganous salts, permanganates, and quinones.

21. A process as in claim 1 performed at temperatures from 20° C. to 30° C.

* * * * *